US005647493A

United States Patent [19]

Sippel

[11] Patent Number: 5,647,493

[45] Date of Patent: Jul. 15, 1997

[54] SHIPPING AND STORAGE RACK

[76] Inventor: David J. Sippel, 10410 Grubbs Rd., Wexford, Pa. 15090

[21] Appl. No.: 471,407

[22] Filed: Jun. 6, 1995

[51] Int. Cl.[6] ..... A47F 5/00

[52] U.S. Cl. ..... 211/194; 211/189; 211/182; 108/53.3

[58] Field of Search ..... 211/189, 194, 211/195, 182; 108/53.1, 53.3, 53.5, 91; 206/599, 600, 386, 443

[56] References Cited

U.S. PATENT DOCUMENTS

| | | | |
|---|---|---|---|
| 2,956,763 | 10/1960 | D'Arca | 206/600 X |
| 3,061,257 | 10/1962 | Shile | 108/53.5 X |
| 3,193,093 | 7/1965 | Hansen | 108/53.5 X |
| 3,620,388 | 11/1971 | Mansson | 206/600 X |
| 3,762,343 | 10/1973 | Thacker | 108/53.5 X |
| 3,857,494 | 12/1974 | Giardini | 211/177 |
| 4,199,069 | 4/1980 | Talarico | 211/194 |
| 4,266,678 | 5/1981 | Daly | 211/194 |
| 4,567,989 | 2/1986 | Hurst, Jr. | 211/74 |
| 4,703,702 | 11/1987 | Speicher | 211/194 X |
| 4,924,783 | 5/1990 | Weizer et al. | 108/53.3 |
| 4,934,538 | 6/1990 | Beyer | 211/49.1 |
| 5,078,278 | 1/1992 | Edmark | 211/41 |
| 5,456,190 | 10/1995 | Good | 108/53.3 |

FOREIGN PATENT DOCUMENTS

| | | | |
|---|---|---|---|
| 556654 | 12/1974 | Switzerland . | |
| 2101963 | 1/1983 | United Kingdom | 206/599 |

*Primary Examiner*—Robert W. Gibson, Jr.
*Attorney, Agent, or Firm*—Kirkpatrick & Lockhart LLP

[57] ABSTRACT

A material handling and storage rack. The rack, in a preferred form, includes a base member and at least two upstanding side members attached to the base member. The side members are configured to be selectively nestingly received in corresponding side members of a second like-constructed rack, when the racks are unloaded. Each of the side members are also equipped with a support member that can be selectively arranged to support the base member of the second rack in a spaced-apart relationship to enable the racks to be stacked on top of each other when loaded. At least one of the side members of the rack may be selectively detached from the base to permit unobstructed access from at least one side of the rack for loading and unloading purposes.

11 Claims, 6 Drawing Sheets

SHIPPING AND STORAGE RACK

BACKGROUND OF THE INVENTION

1. Field of the Invention

The present invention relates to material handling and storage apparatuses for storing and transporting a variety of different materials and, more particularly, to a stackable material storage rack with removable side members.

2. Description of the Invention Background

Every day, reusable racks of all shapes and sizes are utilized across the United States to ship and store a wide variety of articles. Some racks are specially adapted for storing and shipping relatively fragile materials such as flat glass or ceramic and porcelain items such as plumbing fixtures and the like, while other racks serve to support articles such as boards, pipes, aluminum siding, etc. Regardless of the types of articles being stored and shipped, it is advantageous to utilize racks that can safely support the greatest amount of compatible materials while occupying a minimal amount of space in a warehouse or shipping vehicle. It is also desirable to employ racks that can be configured in various compact arrangements when emptied so that even less shipping space is occupied when they are returned to a supplier to be reloaded with material. Of course, when supporting relatively heavy materials, such racks must also be adapted to be manipulated by various material handling devices such as, for example, fork lifts, hand trucks, etc. The racks must also be constructed from material that can withstand the abuse of unloading and loading onto various transportation devices such as trucks, ships, planes, etc.

At present, many storage racks are fabricated from various forms of structural steel and comprise open-ended rectangular-shaped structures that have upwardly extending side members attached thereto. Such racks can often be stacked on top of each other when fully loaded with materials.

Other rectangular storage racks have removable rectangular side or front members that enable the materials stored thereon to be easily removed from the sides of the rack. The sides can also be removed to enable the racks to be more compactly stacked after they have been emptied. Such arrangement is particularly advantageous when returning emptied racks to a supplier because they require less trucking space.

In some rack configurations, the removable side members are attached to the rack base by upstanding socket arrangements adapted to slidably receive corresponding portions of the side members therein. For example, U.S. Pat. No. 3,857,494 to Giardini, U.S. Pat. No. 4,199,069 to Talarico, U.S. Pat. No. 4,924,783 to Weizer et al., and U.S. Pat. No. 4,934,538 to Beyer, disclose storage and shipping racks or containers that have side members or support members removably attached thereto by various socket arrangements.

In particular, the storage and shipping rack disclosed in U.S. Pat. No. 3,857,494 comprises a modular assembly that is fabricated from hollow steel tubing. The rack includes a rigid rectangularly shaped base with vertically disposed legs attached at each corner thereof. The legs are fabricated from lengths of hollow steel tubing that serve to define four-sided sockets adapted to receive a portion of a corresponding side member therein. The removable side members are also fabricated from steel tubing and each have two leg extensions attached thereto that are adapted to be slidably received in a corresponding leg socket. This modular assembly rack is ill-suited for stacking multiple racks on top of one another or in a nested arrangement when the racks have been unloaded.

U.S. Pat. No. 4,199,069 also discloses a storage and transportation rack that is fabricated from steel tubing. The rack comprises a rectangular or square base member that has a vertically extending hollow leg attached to each corner. The legs are also fabricated from tubing and form four-sided sockets into which corresponding vertically extending posts may be slidably inserted. The rack is also equipped with cross members that are adapted to be attached to the posts such that they extend therebetween. While this rack is suited to be stacked on top of other like-constructed racks, it is not well-adapted to be nested with other racks when emptied, short of total disassembly of each rack.

U.S. Pat. No. 4,924,783 discloses a nestable and stackable storage container that is capable of disassembly. The container comprises a deck member and a top frame that are adapted to be interconnected together by a joint arrangement that includes slidably interconnected pieces of steel tubing. While the storage containers are readily stackable when loaded, they must be disassembled to be stacked in a nested arrangement when they are unloaded.

U.S. Pat. No. 4,934,538 also discloses a nestable shipping rack that is fabricated from tubular steel. The rack includes a rectangular base member that has an integral rear upstanding frame. The rack is also equipped with upstanding front receptacle members that are attached to the front corners of the base. The receptacle members are adapted to receive corresponding extension members that are attached to the legs of a removable front gate. Although the rack utilizes square or rectangular upstanding socket arrangements for removably attaching the upstanding front member to provide unobstructed access from the front of the rack and to facilitate nested stacking of the racks, this rack is not well-suited to be stacked on other like racks when fully loaded.

Other storage rack arrangements have been developed that can be stacked on top of each other when loaded and arranged in a nested arrangement when unloaded without disassembling the rack. For example, U.S. Pat. No. 5,078,278 to Edmark discloses a stackable modular storage rack that is adapted to support compact discs and can also be stacked in a nested arrangement. The rack may be injection molded from industrial plastics or it may be fabricated from sheet metal. Various embodiments of the rack employ A-shaped integral side members that are adapted to receive corresponding upstanding members formed on other racks to facilitate the stacking thereof. Although the A-shaped side members are adapted for stacking racks on top of one another, the side members are not removable.

A similar rack arrangement has been developed from steel tubing that can be stacked upon like-constructed racks when fully loaded and nested upon like racks when the racks have been unloaded without disassembling any of the racks. Such rack typically has an elongated base member that has two upstanding side members rigidly and non-removably fastened to each of the longitudinal sides of the base. The side members serve to retain various elongated materials on the base during shipping. To facilitate nestable stacking of emptied racks, the side members are formed in the shape of an inverted "V" or an "A" and are non-removably attached to the sides of the base in a spaced-apart relationship to permit another base to be stacked thereon in a nested fashion. In addition, the side members were also fitted with displaceable support members on their upper strut which could be selectively arranged to support another fully loaded rack thereon. While such rack configuration has addressed some of the problems encountered when using prior racks, it cannot be efficiently loaded and unloaded from the sides because the side members cannot be detached from the base. This rack arrangement, therefore, must be loaded and unloaded from above or from its ends. Such loading and unloading procedures are typically inefficient and cumbersome.

Therefore, there is a need for a material handling and storage rack for storing and transporting a variety of different materials that is capable of being stacked (i.e., multiple loaded racks may be placed on top of each other in a relatively secure position for transport) and also be arranged in a "nested" arrangement (i.e., multiple unloaded racks may be placed within each other in a relatively secure position for transport) when the racks have been unloaded.

There is another need for a material handling and storage rack having the above-mentioned attributes that is also equipped with side support members that can be selectively detached from the rack to permit materials to be readily loaded and unloaded from the sides of the rack.

SUMMARY OF THE INVENTION

In accordance with a preferred form of the present invention, there is provided a material handling apparatus that has a base member and at least two upstanding side members attached thereto. At least one of the upstanding side members is removably attached to the base member. Each upstanding side member is configured to enable a second like-constructed material handling apparatus that has a second base member and second upstanding side members to be stacked on top of the base member in a first position wherein the second base member is received on the base member and the side members of the apparatus are nestingly received in the second upstanding side members of the second apparatus. A support member is attached to each upstanding side member for selectively supporting the second base of the second apparatus in a second position wherein the second base member is supported in a spaced-apart relationship to the base member.

It is an object of the present invention to provide a rack that can be easily adjusted to support other like racks stacked on top of it.

It is another object of the present invention to provide a rack that can be nested with other like-constructed racks when the racks are empty.

Yet another object of the present invention is to provide a rack with the above-mentioned attributes that has at least one side member removably attached thereto such that the rack may be loaded and unloaded from at least one of its lateral sides.

Accordingly, the present invention provides solutions to the aforementioned problems associated with prior rack designs. The skilled artisan will appreciate, however, that these and other details, objects and advantages will become apparent as the following detailed description of a present preferred embodiment thereof proceeds.

BRIEF DESCRIPTION OF THE DRAWINGS

In the accompanying drawings, there are shown present preferred embodiments of the invention wherein like reference numerals are employed to designate like parts and wherein.

DETAILED DESCRIPTION OF THE PREFERRED EMBODIMENTS

Figure 1:
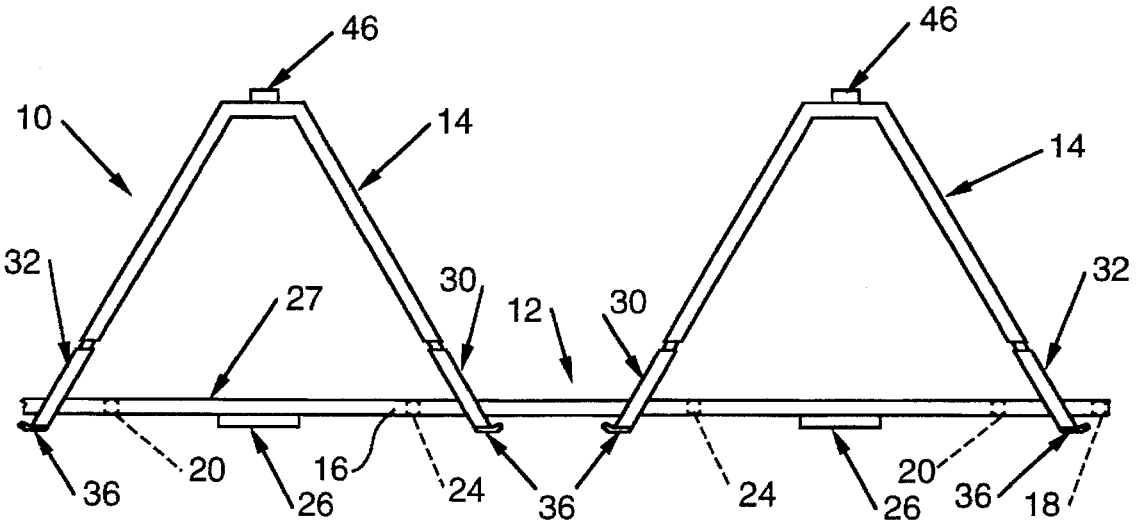
FIG. 1 is a side elevational view of a preferred stackable material storage rack of the present invention.

Referring now to the drawings for the purposes of illustrating the present preferred embodiments of the invention only and not for purposes of limiting the same, the Figures show a stackable material storage rack, generally designated as 10. While the present invention is particularly well-adapted for use in connection with the shipment and storage of materials housed in elongated boxes, the skilled artisan will readily appreciate that the present invention can be used to store and ship a variety of different materials, generally designated as 15, thereon.

More particularly and with reference to FIG. 1, there is shown a preferred embodiment of the present invention which comprises a base member 12 and four upwardly extending side support members 14 removably attached thereto. The base member 12 preferably comprises an elongated rectangle and is preferably fabricated from structural steel tubing that is capable of withstanding the abuse commonly associated with material handling and storage applications. For example, in a preferred embodiment, the base member 12 is fabricated from rectangular or square tubing that is fastened together by welding. Those of ordinary skill in the art will appreciate, however, that the base member 12 can be fabricated from a variety of different materials that are fastened together by other known fastening means without departing from the spirit and scope of the present invention. In addition, although the base member 12 is depicted as an elongated rectangle when viewed from above, the skilled artisan will readily appreciate that the base member may be provided in a variety of other shapes.

Figure 4:
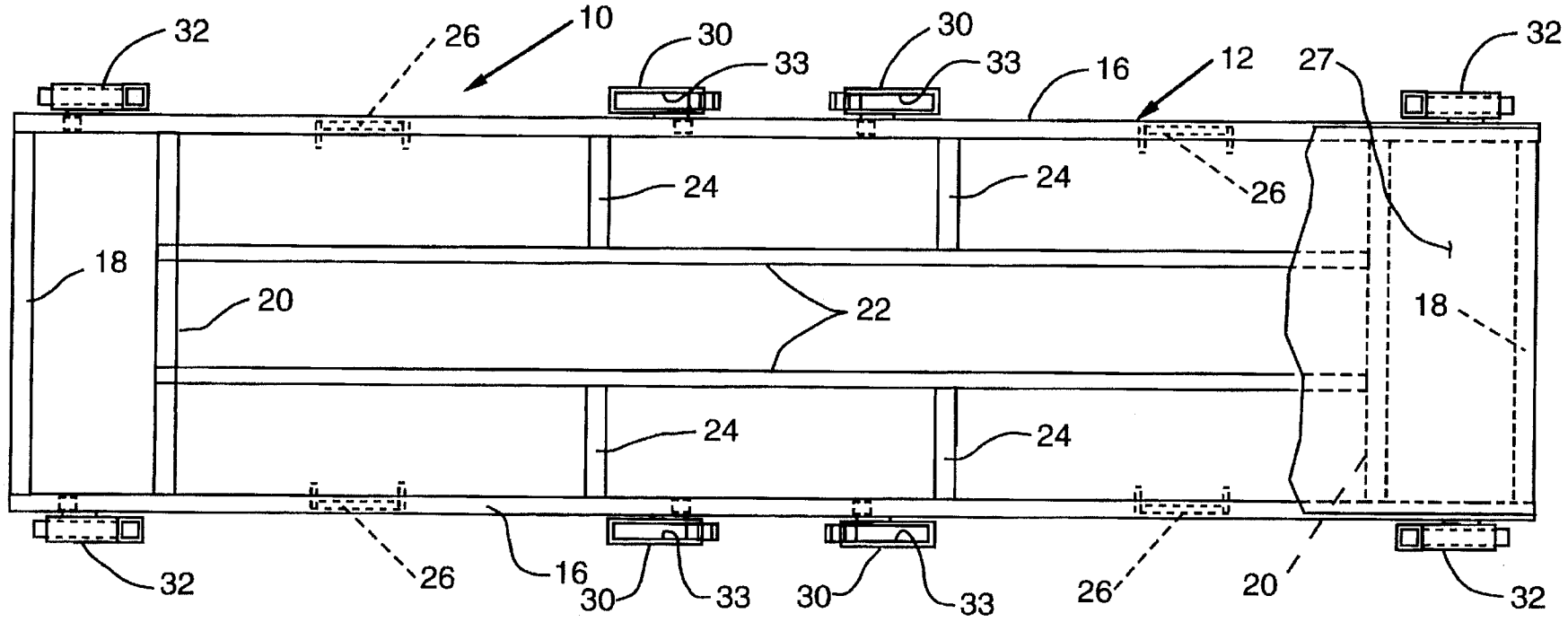
FIG. 4 is a top view of the rack of FIG. 1 with the sides thereof removed for clarity.

As can be seen in FIGS. 1 and 4, a preferred base member 12 has two elongated lateral struts 16 arranged in a spaced-apart parallel relationship that are interconnected at their respective ends by end members 18. Preferably, the base member 12 also has two end struts 20 that are parallel to the end members 18 and are attached to the lateral struts 16, as most particularly shown in FIG. 4. The base member 12 also preferably has two central support struts 22 that are parallel to the lateral struts 16 and are preferably welded between the end support struts 20. In addition, two transverse support braces 24 are preferably welded between each of the central support struts 22 and their corresponding lateral strut 16, as shown in FIG. 4. The skilled artisan will appreciate that the above-described arrangement of struts and braces forming the base 12 can be altered to accommodate the types of materials that are to be supported thereon. Also, in a preferred embodiment, a support member 27, preferably fabricated from sheet metal, is attached to the base 12 to provide a flat bearing surface thereon. I have also found that by attaching the support member 27 to the base member 12, the structural rigidity of the rack 12 may be improved. It will be further appreciated, however, that other materials such as plywood, plastic, etc. may be attached or loosely placed on the base in applications wherein a flat bearing surface is desired.

I have also found it particularly advantageous to provide a rack that has upstanding side support members 14 removably attached thereto along the lateral sides of the base member 12. As will become evident as the present Detailed Description proceeds, such side support members 14 serve to retain stacked materials on the rack 10 while enabling the rack 10 to be easily loaded and unloaded from its lateral sides by selectively removing the side support members 14. As was mentioned above, the rack 10 is preferably provided with four removable side members 14, the construction of which will be discussed in further detail below. It will be appreciated, however, that the rack may be equipped with any number of side support members 14 and that some of the side support members may be rigidly affixed to the rack's base member 12.

As can be seen in FIGS. 1 and 4, the side support members are adapted to be attached to the base member 12 by corresponding vertically inclined socket members (30, 32) attached to the base member 12. Socket member 32 is preferably fabricated from a hollow piece of steel tubing that defines a "four-sided" socket when viewed from its open end. Socket member 30 is also preferably fabricated from a hollow piece of steel tubing; however, one lateral side of the tubing is removed to define a lateral opening 33, thus forming a "three-sided" socket. As most particularly shown in FIG. 4, the socket members (30, 32) are arranged in pairs along the sides of the base member 12 such that one "pair" comprises a socket 30 and a socket 32 on the same side of the base member 12. It will be understood that the sockets (30, 32) that form a pair are angled toward each other with the open side 33 of a socket 30 being located away from the corresponding socket 32. See FIG. 4.

Figure 3:
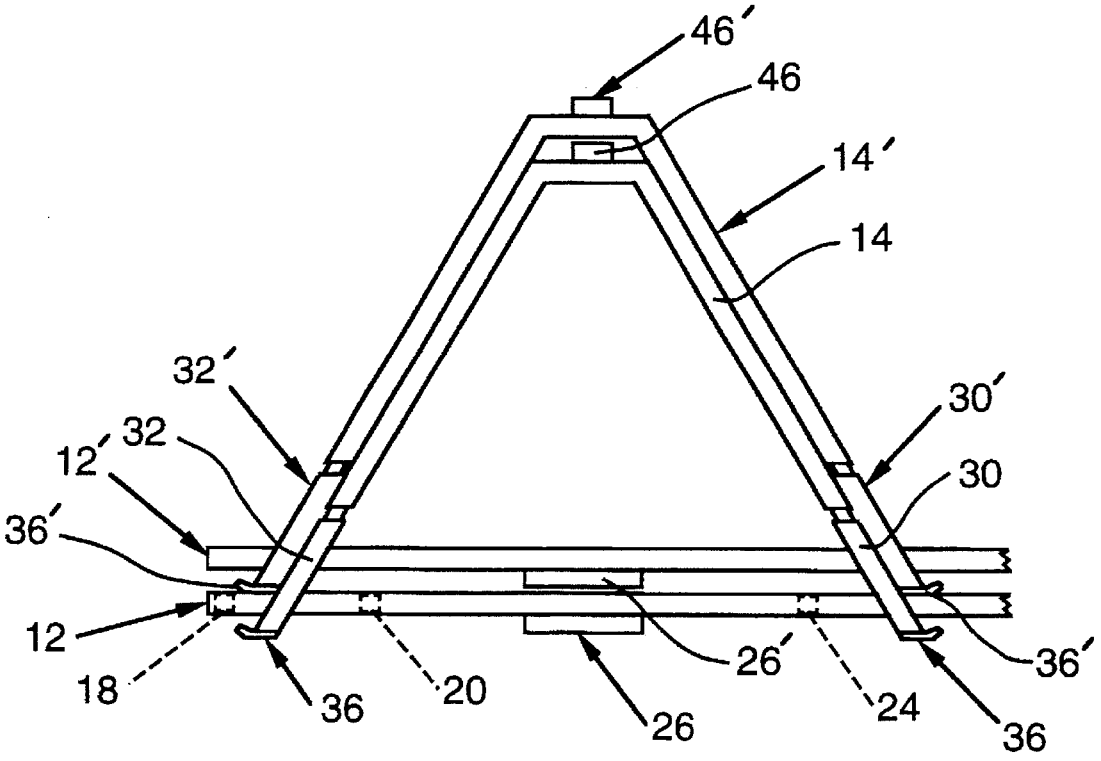
FIG. 3 is a partial side elevational view of the stackable material storage rack of FIGS. 1 and 2 nested within another like rack.
Figure 6:
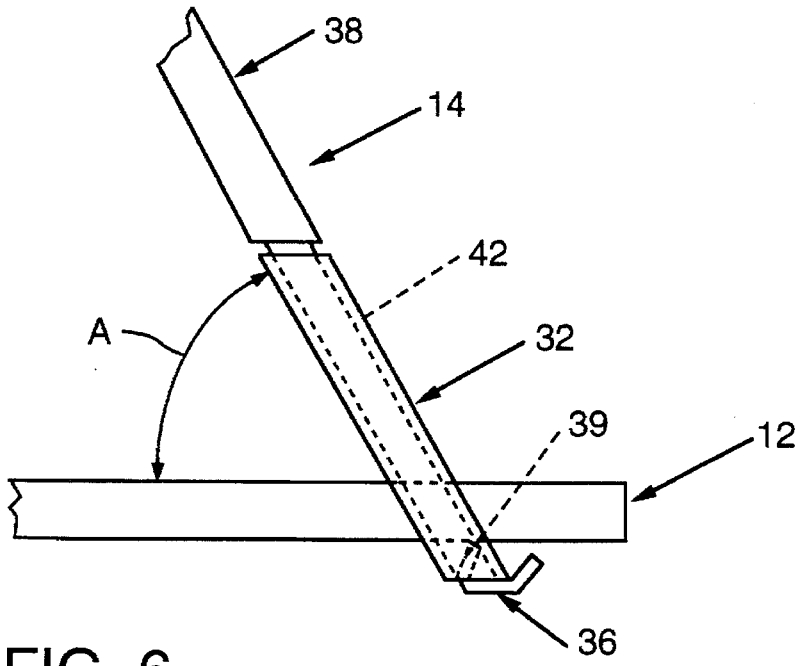
FIG. 6 is a side view of a socket member of the present invention attached to the rack base with a corresponding extended portion of a preferred side member received therein.
Figure 7:
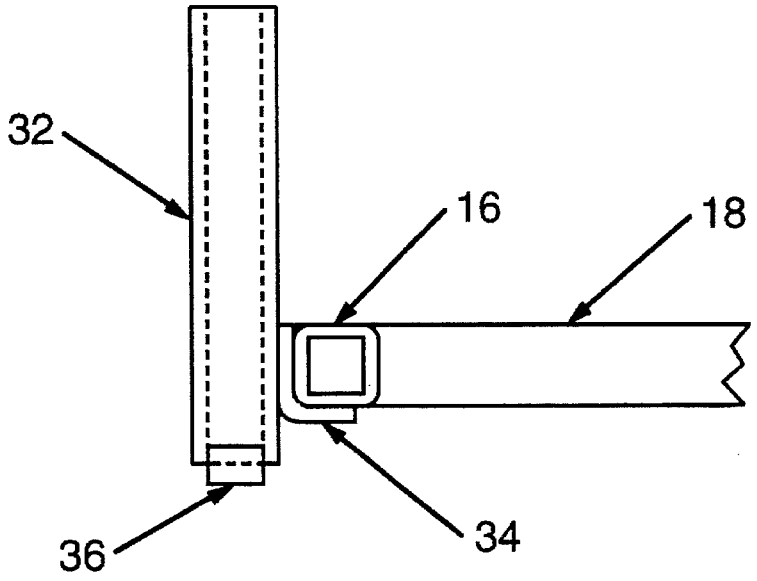
FIG. 7 is a side view of a preferred attachment arrangement for attaching a socket member to the base of the present invention.

The socket members (30, 32) are preferably attached to the base member 12 at an angle designated by the arrow "A" in FIG. 6. In a preferred embodiment, angle "A" is sixty degrees; however, other angular orientations may also be successfully used. The socket members (30, 32) are preferably attached to the lateral side members 16 by an L-shaped spacer member 34, preferably by welding or other suitable fastening means. See FIG. 7. The spacer member 34 is preferably fabricated from angle iron or flat structural steel bent to a right angle. One leg of the spacer member 34 is positioned between a corresponding socket member (30, 32) and a corresponding lateral strut 16 and the other leg of the spacer 34 is preferably welded to the underside of the lateral strut 16. The skilled artisan will further appreciate that by mounting the sockets (30, 32) such that they are spaced slightly apart from the base 12, another base 12' may be stacked on the base 12 without contacting the side support members 14 thereof. See FIG. 3.

Figure 8:
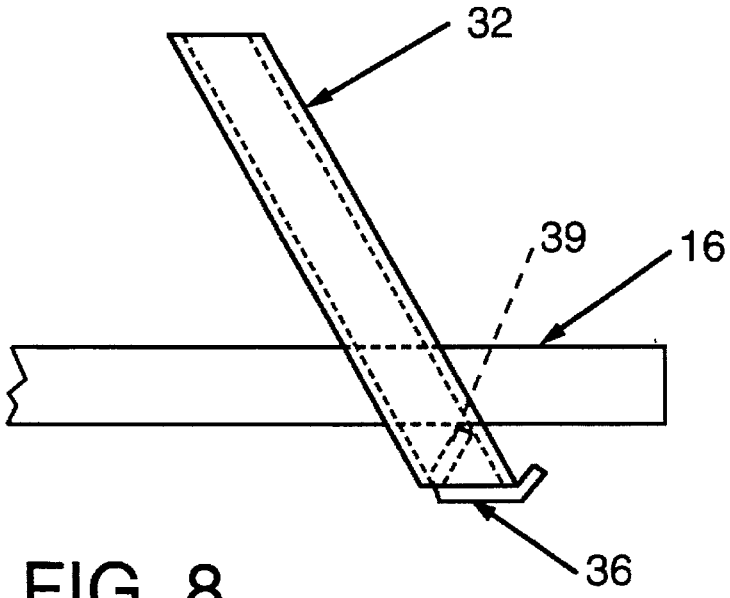
FIG. 8 is another side view of a preferred socket of the present invention.

In a preferred embodiment, the vertically inclined socket members (30, 32) extend below the base member 12 to form support legs for the base member 12. It will be appreciated that the legs serve to sufficiently support the base member 12 above a surface such that lift forks of a material handling device may be inserted under the base member 12 to enable the rack 10 to be manipulated and transported thereby. To enable the rack to be "skidded" on a surface, each socket member (30, 32) is preferably provided with a skid pad 36. Skid pads 36 are each preferably fabricated from a piece of flat structural steel configured as shown in FIG. 8 to provide each skid pad 36 with an upper angled portion 39. The angled portion 39 is adapted to extend into the bottom of the corresponding socket (30, 32) and be welded thereto. In the alternative, commercially available casters (not shown) may be attached to the underside of the base member 12 to enable the base member 12 to be rollably displaced on a surface.

Figure 5:
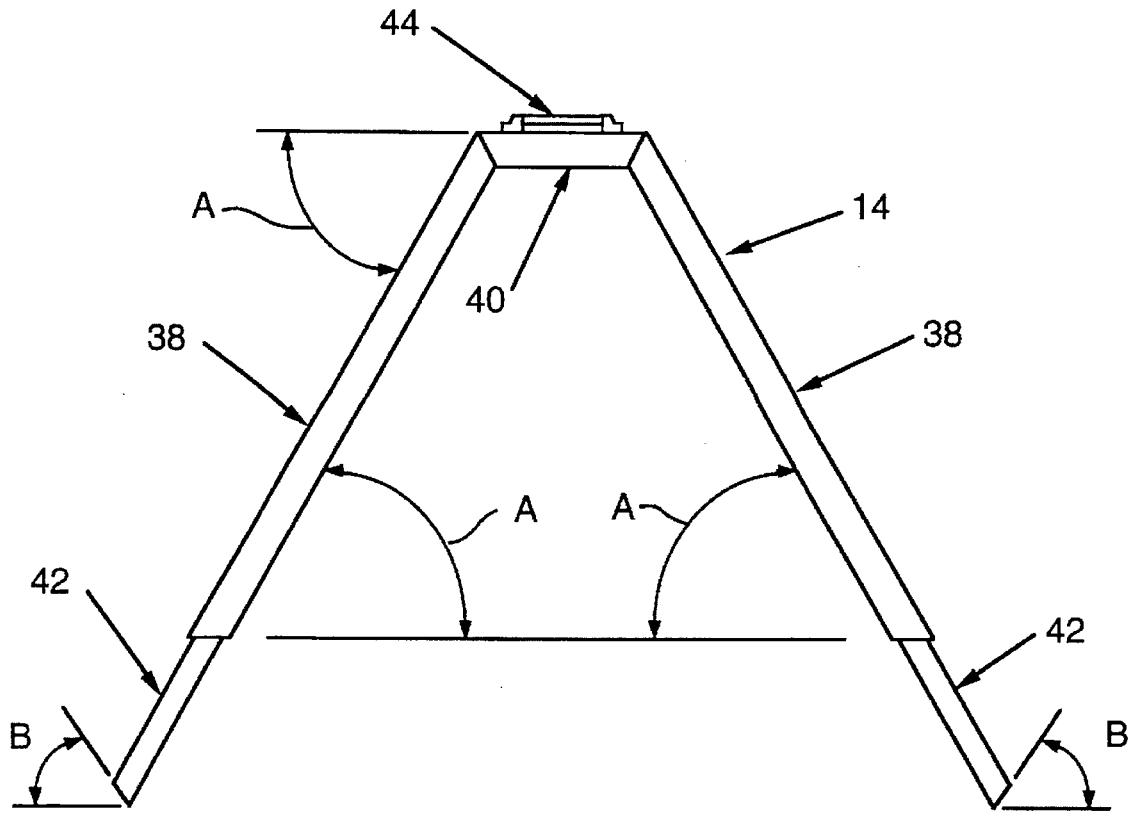
FIG. 5 is side view of a preferred side member of the present invention.

The side support members 14 of the present invention are preferably fabricated from a continuous piece of structural steel tubing that is formed with two diagonally extending legs 38 in the shape illustrated in FIG. 5. Such shape will be herein referred to as an "A"-shape. The reader will appreciate, however, that the side support members 14 may have the shape of an inverted "V" having two diagonally extending legs. In a preferred embodiment, as can be seen from reference to FIG. 5, each side support member 14 has a central portion 40 that has a diagonal leg portion 38 protruding from each end thereof preferably arranged at angle "A" that corresponds to the angle at which the socket members (30, 32) are arranged (preferably sixty degrees). In an alternative embodiment, the side support members 14 may be fabricated from corresponding pieces of tubular steel welded together in the shaped depicted in FIG. 5. Each diagonal leg portion 38 preferably has an extended connection member 42 attached thereto that is sized to be slidably received in a corresponding socket member (30, 32). The extended connection member 42 is attached to its corresponding diagonal leg portion 38 preferably by welding. However, the extended connection members 42 may be attached to the diagonal leg portions 38 by removable fasteners such that they can be quickly detached from the leg portion 38 should they become damaged and deformed.

In a preferred embodiment, the lower end of each extended connection member 42 is formed at an angle (preferably thirty degrees), designated by the arrow "B" in FIG. 5, to facilitate its insertion into and removal from a corresponding socket member (30, 32). As can be seen in FIG. 8, the angled portion 39 of the skid pad 36 is arranged at a complementary angle with respect to the angled end of the extended connection member 42 to provide a corresponding angled bearing surface therefor. The skilled artisan will, of course, appreciate that the diagonal leg portions 38 may be sized to be slidably received within the corresponding sockets (30, 32), thus eliminating the need for the extended connection members 42.

As was discussed above, the socket members (30, 32) are arranged in pairs on the lateral sides of the base member 12. Thus, to removably attach a side support member 14 to the base 12, its extended connection members 42 are aligned with corresponding sockets (30, 32) and they are slidably inserted therein. It will be appreciated that this unique three-sided and four-sided socket arrangement enables the side support members to be quickly attached to the base 12 and quickly detach therefrom to facilitate loading and unloading of the rack 10. It will be further appreciated, however, that the side support members 14 could also be removably attached to the base member 12 if all of the upstanding socket members were three-sided. Also, those of ordinary skill in the art will understand that the side support members 14 may be removably retained in their corresponding sockets (30, 32) by appropriate pinning means.

In the preferred embodiment, the vertically inclined socket members (30, 32) are oriented such that the three-sided socket member 30 is located to the center of the base member 12 and the four-sided socket member 32 is located to the outside of the base member. See FIG. 4. Those of ordinary skill in the art will appreciate, however, that the vertically inclined socket members (30, 32) may be attached to the base member 12 in a variety of different orientations without departing from the spirit and scope of the present invention.

Figure 2:
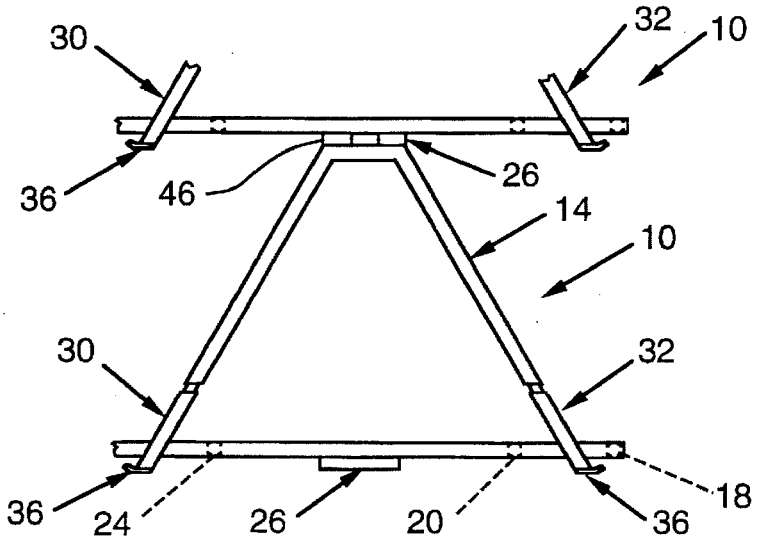
FIG. 2 is a partial side elevational view of the stackable material storage rack of FIG. 1, supporting another like rack.
Figure 9:
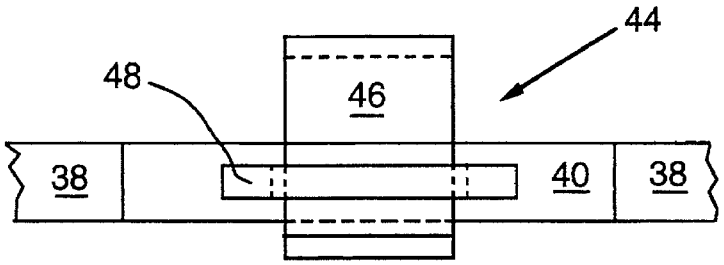
FIG. 9 is a partial top view of a side support member of the present invention with a preferred slidable support assembly attached thereto.
Figure 10:
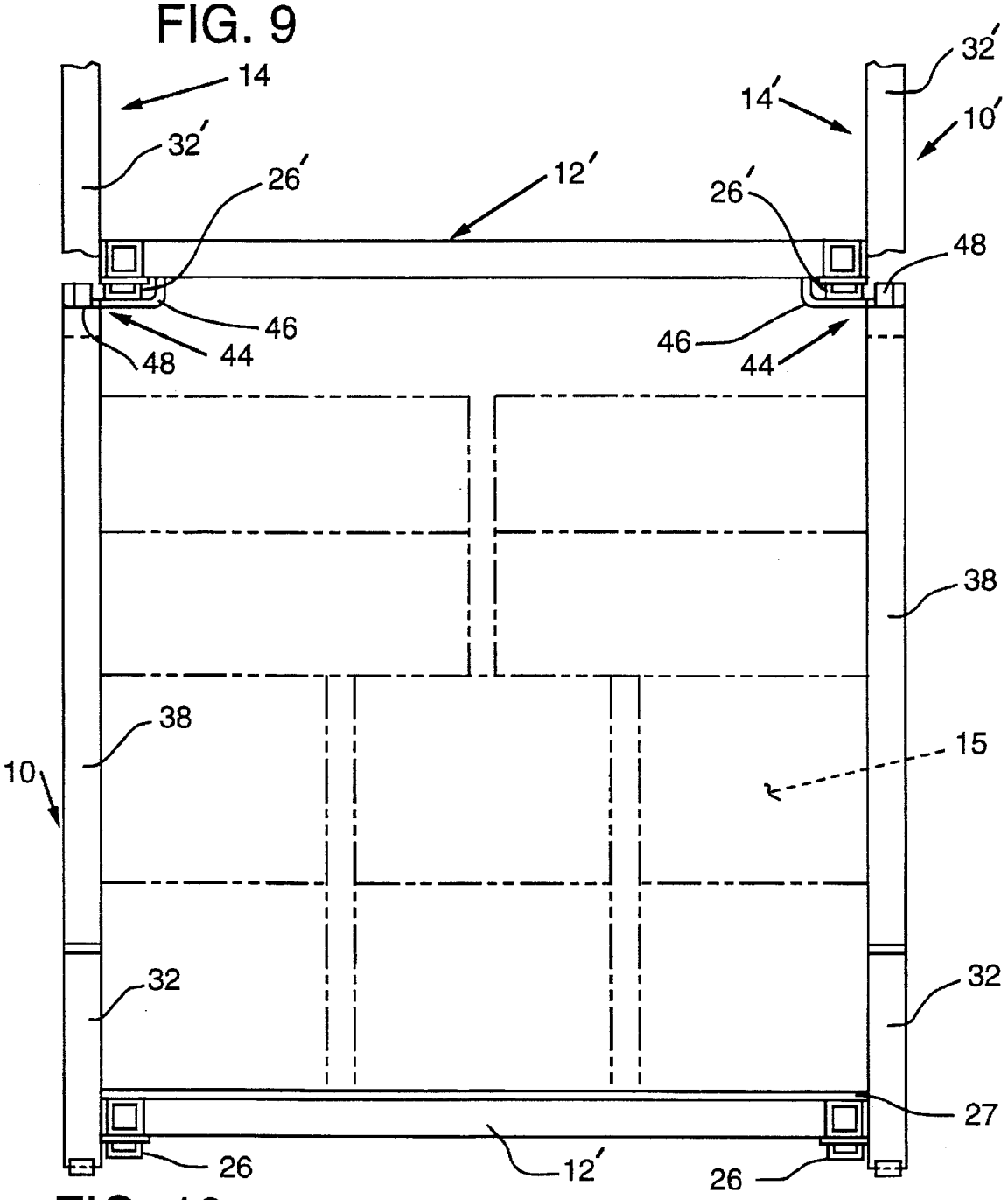
FIG. 10 is a partial end elevational view of two preferred racks of the present invention with one rack stacked on top of the other.

In a preferred embodiment, the side support members 14 each have a slidable support assembly 44, attached thereto. As can be seen in FIG. 9, a slidable support assembly 44 comprises a C-channel 46 that is slidably attached by a C-shaped retaining bar 48 that is welded to the top of the center connecting portion 40. As can be seen in FIG. 10, when the C-channels 46 are slidably positioned such that they extend above the base member 12, the base member 12' of another rack may be stacked thereon. When the loaded racks 10 are not being stacked on top of each other, the C-channel 46 can be slidably positioned such that it does not interfere with the materials loaded thereon. Also, to provide additional space between the racks 10 when they are stacked as illustrated in FIGS. 2 and 10, a spacer member 26, preferably fabricated from an additional length of structural tubing, is preferably attached to the bottom of the lateral struts 16 at four places. See FIGS. 4 and 10. Spacer members 26 are arranged to be selectively received in the C-channels 46 to provide additional space between the racks when they are stacked on top of each other to thereby enable the forks of a material handling device to be inserted therebetween. Thus, such support bracket arrangement enables the racks 10 of the present invention to be stacked on each other while supporting materials 15 therein. See FIG. 10.

Accordingly, the above described material handling and storage apparatus provides solutions to the aforementioned problems associated with other material handling and storage apparatuses. As can be appreciated from the foregoing description, the subject rack can support other like-constructed racks in a stacked fashion when fully loaded. In addition, the subject rack, when empty, can be stacked with other like-constructed rack in a nested fashion. The unique detachable sides of the subject rack also afford unobstructed access to the side of the rack during loading an unloading operations. Thus, the subject rack enables warehouse storage space and shipping space to be optimally used, while also facilitating safe and efficient loading and unloading procedures. It will be understood, however, that various changes in the details, materials and arrangements of parts which have been herein described and illustrated in order to explain the nature of the invention may be made by those skilled in the art within the principle and scope of the invention as expressed in the appended claims.

What is claimed is:

1. A material handling apparatus comprising:

a base member;

at least two upstanding side members attached to said base member, wherein at least one upstanding side member is removably attached to said base member in an upright supporting position relative thereto, said upstanding side members configured such that a second like-constructed material handling apparatus having a second base member and second upstanding side members corresponding to said upstanding side members may be selectively stacked on top of said base member in a first unloaded position wherein said second base member is received on said base member and said upstanding side members are nestingly received in said corresponding second upstanding side members when said upstanding side members are in said upright supporting positions; and support means attached to said upstanding side members such that said second base member of said second like-constructed material handling apparatus may be selectively supported in a second loaded position wherein said second base member is supported in a spaced-apart relationship to said base member.

2. The material handling apparatus of claim 1 wherein each said upstanding side member is removably attached to said base member by at least one corresponding socket member attached to said base member, said corresponding socket member constructed to receive a corresponding leg portion of said side member therein.

3. The material handling apparatus of claim 2 wherein at least one of said socket members of each said pair of socket members has an open lateral side therein.

4. The material handling apparatus of claim 2 wherein each said socket member extends below said base member to serve as a support leg.

5. The material handling apparatus of claim 2 wherein each said diagonal leg portion has an extended connection member attached thereto that is sized to be received in said socket members.

6. The material handling apparatus of claim 1 wherein said upstanding side members are A-shaped.

7. A material handling apparatus, comprising:

a base member;

at least two upstanding side members attached to said base member, each said side member having two diagonally extending leg portions extending therefrom; and at least one pair of socket members attached to said base member and corresponding to at least one of said upstanding side members for removably attaching said corresponding upstanding side member to said base member, each said socket member defining a socket into which a portion of one of said diagonal legs of said corresponding upstanding side member is slidably and detachably inserted therein, at least one said socket member of each said pair having an open lateral side through which a portion of one of said diagonally extending legs of said corresponding upstanding side member may pass.

8. The material handling apparatus of claim 7 further comprising support means attached to each said upstanding side members for selectively supporting a second base member of a second material handling apparatus in a spaced-apart relationship to said base member.

9. The material handling apparatus of claim 7 wherein each said socket member extends below said base member to serve as a support leg.

10. The material handling apparatus of claim 7 wherein said diagonal leg portions of each said removable side member each have an extended connection member attached thereto that is sized to be received in said socket members.

11. The material handling apparatus of claim 7 wherein said upstanding side members are A-shaped.

* * * * *